United States Patent [19]

Henne et al.

[11] Patent Number: 4,664,322

[45] Date of Patent: May 12, 1987

[54] TUBE MILL

[75] Inventors: Heinrich Henne, Ennigerloh; Norbert Patzelt, Beckum; Karl-Heinz Alker, Ahlen, all of Fed. Rep. of Germany

[73] Assignee: Krupp Polysius AG, Beckum, Fed. Rep. of Germany

[21] Appl. No.: 653,085

[22] Filed: Sep. 21, 1984

[30] Foreign Application Priority Data

Oct. 18, 1983 [DE] Fed. Rep. of Germany ..... 3337877

[51] Int. Cl.[4] ..... B02C 17/24

[52] U.S. Cl. ..... 241/176; 34/121; 241/179; 241/299

[58] Field of Search ..... 241/285 R, 285 A, 285 B, 241/54, 70, 71, 72, 78, 45, 101.2, 176, 177, 178, 179, 180, 181, 182, 183, 153, 299; 51/164.1; 34/109, 121, 113; 366/58, 63, 200, 214, 60, 220, 228, 229; 432/103; 266/173; 165/89-91; 209/288-290; 285/134, 135; 210/402-404; 74/63, 434, 450, 439

[56] References Cited

U.S. PATENT DOCUMENTS

| | | | |
|---|---|---|---|
| 1,525,790 | 2/1925 | Bartley | 241/176 |
| 1,614,899 | 1/1927 | Read | 241/72 |
| 3,220,658 | 11/1965 | Shelton | 241/285 A |
| 4,043,514 | 8/1977 | Peterson | 241/285 B X |
| 4,083,500 | 4/1978 | Kartman | 241/54 |

FOREIGN PATENT DOCUMENTS

| | | | |
|---|---|---|---|
| 13369 | 9/1903 | Austria | 241/177 |
| 16837 | 1/1907 | Norway | 209/289 |
| 6464 | of 1910 | United Kingdom | 241/72 |

*Primary Examiner*—Mark Rosenbaum
*Attorney, Agent, or Firm*—Learman & McCulloch

[57] ABSTRACT

The invention relates to a tube mill in which the cylinder of the drying chamber and the transition wall which it supports are divided centrally or a number of times in the axial direction so that this cylinder and the transition wall can be replaced without the grinding elements having to be removed from the grinding chamber.

9 Claims, 4 Drawing Figures

TUBE MILL

The invention relates to a tube mill adapted for use in the grinding and drying of materials.

BACKGROUND OF THE INVENTION

In tube mills for grinding and drying materials a drying chamber which serves for preliminary drying of the material to be ground frequently is arranged in advance of the actual grinding chamber. This drying chamber and the transition wall between it and the grinding chamber are often exposed to severe wear. The replacement of worn parts, and particularly the transition wall, generally necessitates shutting down of the whole grinding operation for a long period of time since for this purpose all the grinding balls have to be removed from the grinding chamber and put back in again after the repair has been carried out.

An object of the invention is to provide a tube mill of the type referred to and which enables the time during which the grinding plant is shut down for maintenance and repair work in the region of the drying chamber and the transition wall to be reduced to a minimum.

SUMMARY OF THE INVENTION

A tube mill constructed according to the invention has a cylindrical drying chamber connected to a bearing ring, independently of the cylinder of the grinding chamber, by separate screws which are accessible from the outside. In addition the cylinder of the drying chamber and the transition wall which it supports are divided centrally, or a number of times, in the axial direction, and therefore during maintenance and repair work the mill can be placed so that the dividing line lies approximately horizontally or at least so that the upper part (half) of the cylinder of the drying chamber with the part (half) of the lifting wall which it supports can be unscrewed and replaced by a new one without it being necessary to remove the grinding elements from the grinding chamber for this purpose. After rotation of the mill an appropriate amount of the other parts of the cylinder of the drying chamber and the transition wall can also be replaced in the same way (if the drying chamber cylinder and transition wall are divided centrally the mill can be appropriately rotated by approximately 180° in order to be able to replace the other half of the cylinder and the transition wall).

In this way a worn drying chamber with transition wall can be replaced by a new one in the shortest possible time. For this purpose it is not necessary to remove the grinding elements from the grinding chamber nor is it necessary to dismantle the inlet device of the mill. This results in a very short shut-down period for the grinding plant and repair of the removed parts outside the mill at low cost. In case of need it is also possible to replace only one part or one half of the drying chamber and the transition wall.

THE DRAWINGS

A tube mill according to the invention is illustrated in the accompanying drawings, in which.

DETAILED DESCRIPTION

Figure 1:
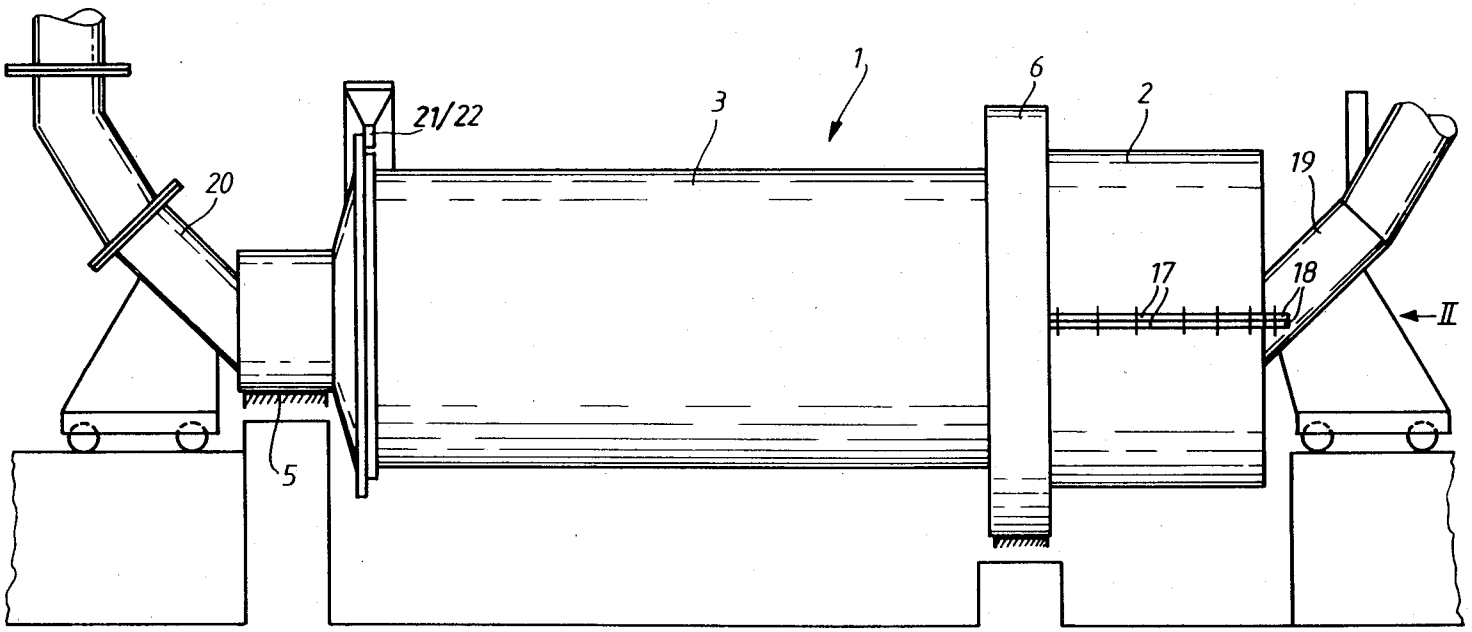
FIG. 1 is a schematic, side elevational view of one embodiment of the tube mill.
Figure 2:
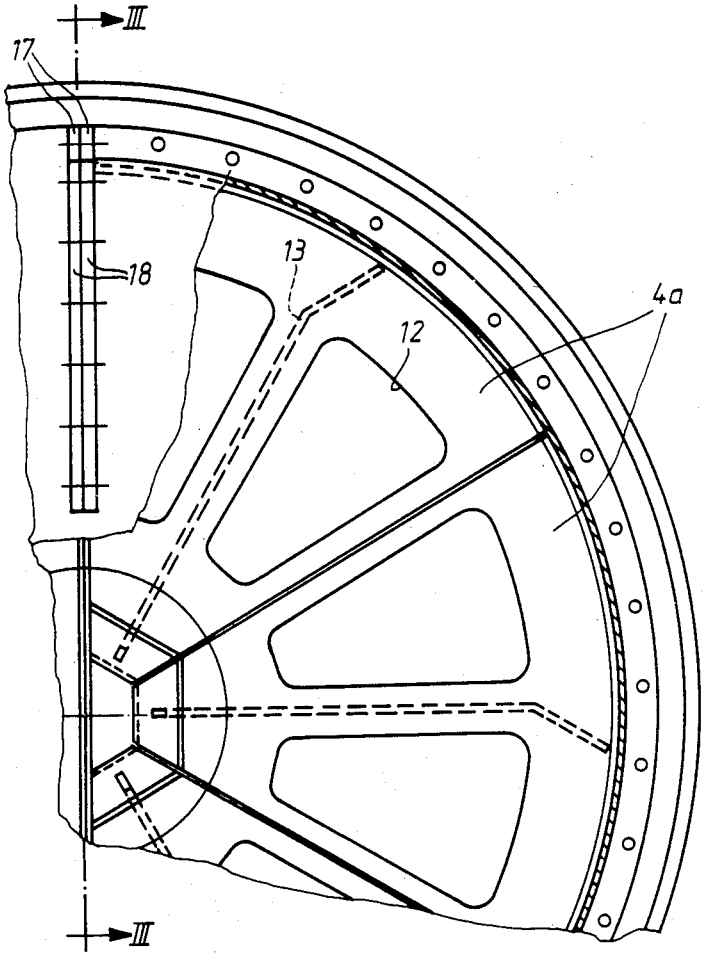
FIG. 2 is a partially cut-away end view of the drying chamber, as viewed in the direction of the arrow II in FIG. 1.
Figure 3:
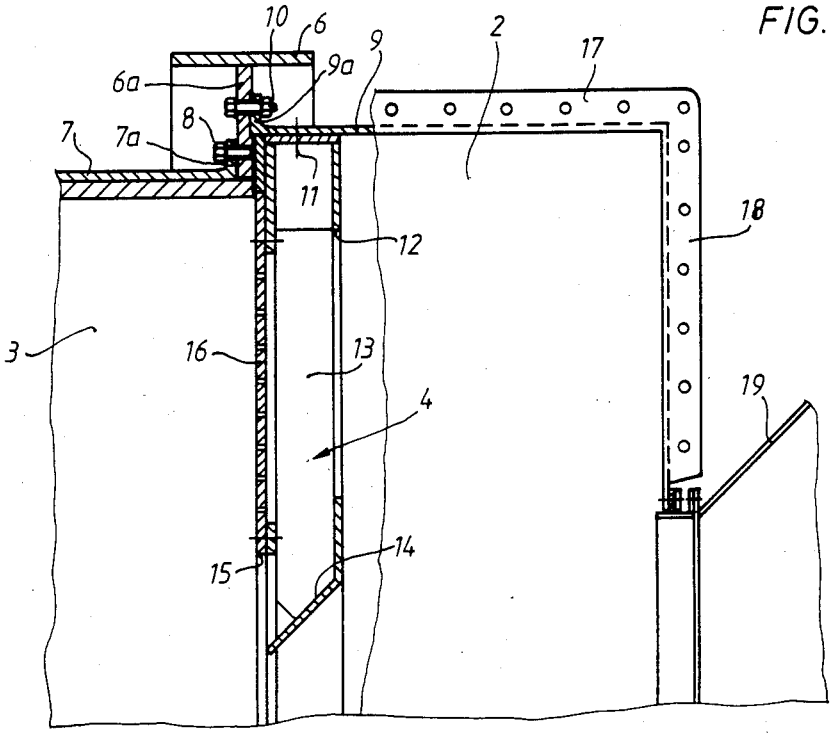
FIG. 3 is a section taken along the line III—III of FIG. 2.

The tube mill 1 shown in FIG. 1 contains a drying chamber 2 and a grinding chamber 3. Between the drying chamber 2 and the grinding chamber 3 is a transition or lifting wall 4 which is best shown in FIGS. 2 and 3.

The tube mill 1 is mounted on the one hand in the region of a collar bearing 5 and on the other hand by means of a bearing ring 6 encircles the mill at the transition zone between the drying chamber 2 and the grinding chamber 3.

The cylinder 7 of the grinding chamber 3 is screwed to the cross-piece or annular flange 6*a* of the bearing ring 6 by means of a radial flange 7*a* and screws 8.

The cylinder 9 of the drying chamber 2 is connected to the annular flange 6*a* of the bearing ring 6 by means of a radial flange 9*a* and screws 10. As can be seen from FIG. 3, the radial flanges 7*a* and 9*a* terminate short of one another to provided an axial space for the annular flange 6*a* and also are radially spaced so that the screws 10 are arranged on a greater diameter than the screws 8 and are readily accessible from the outside.

The transition wall 4 consists of individual segments 4*a* and is fixed on the cylinder 9 of the drying chamber 2 by means of screws 11. On the side facing the drying chamber 2 the transition wall 4 is provided with openings 12 for the introduction of the material to be ground. Lifting blades 13 convey the material to be ground to a central cone 14 over which the material passes through an opening 15 in the wall portion 16 facing the grinding chamber 3 and into the grinding chamber 3.

The cylinder 9 of the drying chamber 2 and the transition wall 4 which it supports are divided centrally in the axial direction in the illustrated embodiment (naturally axial division into several parts is also possible). The two halves (or the parts) of the cylinder 9 of the drying chamber 2 are connected to each other by means of axially extending flanges 17 on the outer periphery of the cylinder 9 and by means of radially extending flanges 18 on the end wall of the cylinder.

The dividing line of the transition wall 4 runs in each case as an extension of the dividing line of the cylinder 9 of the drying chamber 2. In order to ensure that the parts (halves) of the transition wall 4 also hold together satisfactorily in the inner region and to avoid internal screw connections as much as possible, the parts or the two halves of the transition wall 4 can interengage by means of a plug connection.

The inlet device to the tube mill 1 is designated 19 in FIG. 1 and the outlet device is designated 20. The reference characters 21 and 22 designate the gear ring and pinion, respectively, to drive the tube mill.

If the tube mill is rotated for example into the position shown in FIG. 1, in which the dividing line (flanges 17, 18) between the two halves of the cylinder 9 of the drying chamber 2 is approximately horizontal, then by undoing the relevant screws 10 the upper half of the cylinder 9 with the upper half of the lifting wall 4 which it supports can be replaced. During this the lower half of the lifting wall 4 holds the grinding elements located in the grinding chamber 3. After the insertion of a new half of the cylinder 9 of the drying chamber 2 with the associated half of the lifting wall 4, the tube mill 1 can then be rotated by 180° and the other half can also be replaced.

Figure 4:
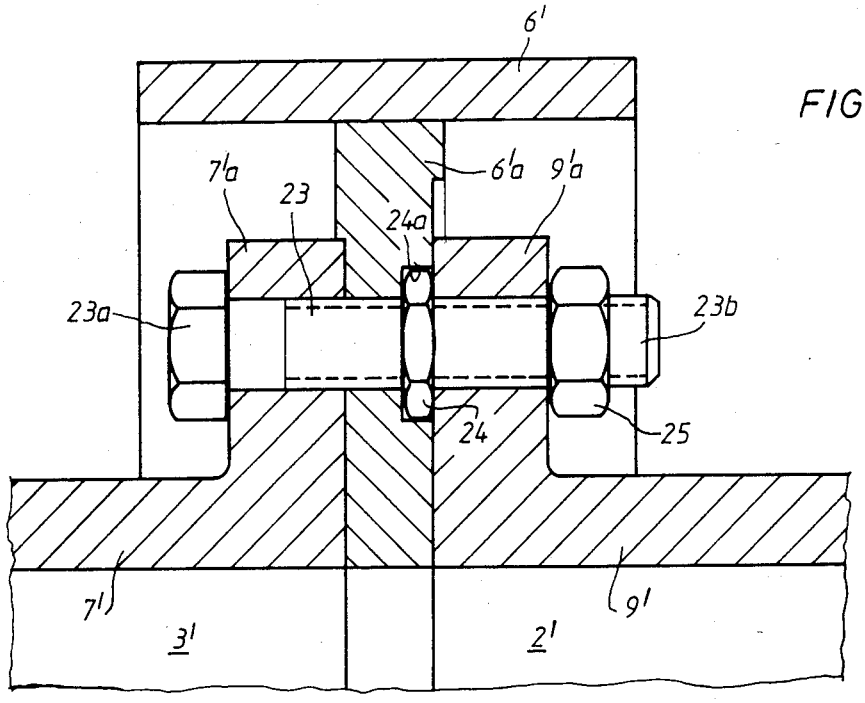
FIG. 4 is a partial longitudinal section through the grinding chamber cylinder and the drying chamber cylinder in the region of their connection to the bearing ring of a second embodiment.

A second embodiment for the fastening between the grinding chamber cylinder and the drying chamber cylinder on the bearing ring is explained with the aid of FIG. 4.

While in the first embodiment separate screws 8 and 10 respectively are provided for the connection between the grinding chamber cylinder 7 and bearing ring 6 on the one hand and for the connection between the drying chamber cylinder 9 and the bearing ring 6 on the other hand at different diameters of the bearing ring annular flange 6*a*, in the embodiment of FIG. 4 the radial flanges 7′*a* and 9′*a* of the respective cylinders are coaxial and there is a common fastening of the grinding chamber cylinder 7′ and the drying chamber cylinder 9′ on the bearing ring 6′ or on the annular flange 6′*a* thereof in only one row of screws at the same diameter.

For the sake of simplicity only one such screw connection point is shown in FIG. 4, but naturally an appropriate number of such screw connection points are provided over the periphery of the bearing ring 6′ or its cross-pieces 6′*a*. Each of these screw connection points contains one single screw bolt 23 which passes through the radial flanges 7′*a* and 9′*a* of the grinding chamber cylinder 7′ and the drying chamber cylinder 9′ respectively which butt against the annular flange 6′*a* on opposite sides and the bearing ring cross-piece 6′*a* and rests with its bolt head 23*a* on the flange 7′*a* of the grinding chamber cylinder 7′. An auxiliary nut 24 which produces a reliable, independent first connection between the radial flange 7′*a* of the grinding chamber cylinder 7′ and the bearing ring annular flange 6′*a* is initially screwed onto each of the screw bolts 23 (approximately in the central section of the bolt), and the auxiliary nut 24 is advantageously arranged so that it is countersunk in an associated recess 24*a* in the bearing ring annular flange 6′*a*. In this way the cylinder 7′ of the grinding chamber 3′ is held by force on the annular flange 6′*a* of the bearing ring 6′.

A second connection which is independent of the first connection described above is produced by the same screw bolts 23 with the aid of an external nut 25 which is screwed onto the axially outer end 23*b* of the screw bolt so that the annular flange 9′*a* of the drying chamber cylinder 9′ is fixed by force on the bearing ring annular flange 6′*a*.

Thus when a part of the cylinder 9′ of the drying chamber 2′ together with the part of the lifting wall which is mounted on it are to be replaced, it is sufficient merely to undo the outer nuts 25 of the relevant screw bolts 23 in order to remove the relevant cylinder part and replace it by a new one without having to undo the screw connection between the grinding chamber cylinder 7′ and the bearing ring 6 (by the auxiliary nut 24).

We claim:

1. A rotary tube mill comprising a first cylinder forming a drying chamber and terminating at one end in a radial flange; a second cylinder forming a grinding chamber and terminating at one end in a radial flange confronting but axially short of said one end of said first cylinder to provide an axial space between adjacent ends of said cylinders, at least one of said cylinders being divided axially to form a plurality of arcuate sections; a bearing ring encircling said cylinders at their confronting ends and having an annular flange occupying said space and in engagement with the radial flanges of both of said cylinders; first fastening means accessible from outside said mill separably securing the radial flange of one of said cylinders to said annular flange; second fastening means accessible from outside said mill separably securing the radial flange of the other of said cylinders to said annular flange; and means separably coupling the arcuate sections of said one of said cylinders to one another, the fastening means of at least said one of said cylinders being separable from said annular flange independently of the fastening means of the other of said cylinders so that said other of said cylinders may remain secured to said bearing ring while one or more of said arcuate sections of said one of said cylinders is or are separated from said bearing ring.

2. A tube mill according to claim 1 wherein said first and second fastening means comprises separate sets of circumferentially spaced bolts extending between said annular flange and the radial flanges of the respective cylinders.

3. A tube mill according to claim 2 wherein the bolts of one of said sets are arranged on a diameter greater than that of the bolts of the other of said sets.

4. A tube mill according to claim 1 wherein said first and second fastening means comprise a single set of circumferentially spaced bolts each of which extends through said annular flange and both of said radial flanges.

5. A tube mill according to claim 4 wherein each of said bolts has a threaded shank terminating at one end in a head bearing on the radial flange of one of said cylinders and having a nut at its opposite end bearing on the radial flange of the other of said cylinders, and an auxiliary nut between the ends of said shank bearing on said annular flange.

6. A tube mill according to claim 5 wherein said auxiliary nut is accommodated in a recess formed in said annular flange.

7. A tube mill according to claim 1 wherein said radial flanges are radially spaced from one another and said annular flange is of such radial length as to span both of said radial flanges.

8. A tube mill according to claim 1 wherein said radial flanges are substantially coaxial.

9. A rotary tube mill comprising a first cylinder terminating at one end in a radial flange; a second cylinder terminating at one end in a radial flange confronting but axially short of said one end of said first cylinder to provide an axial space between adjacent ends of said cylinders; a bearing ring encircling said cylinders at their confronting ends and having an annular flange occupying said space and in engagement with the radial flanges of both of said cylinders; first fastening means accessible from outside said mill separably securing the radial flange of one of said cylinders to said annular flange; and second fastening means accessible from outside said mill separably securing the radial flange of the other of said cylinders to said annular flange, the fastening means of each of said cylinders being separable from said annular flange independently of the fastening means of the other of said cylinders, thereby enabling either of said cylinders to be separated from said bearing ring while the other of said cylinders remains secured to said bearing ring.

* * * * *